US009422734B1

(12) United States Patent
Heady et al.

(10) Patent No.: US 9,422,734 B1
(45) Date of Patent: Aug. 23, 2016

(54) SYSTEM AND METHOD FOR STRAIGHTENING AND/OR SUPPORTING A WALL

(71) Applicant: Power Brace LLC, Des Moines, IA (US)

(72) Inventors: Timothy P. Heady, Elkhart, IA (US); Charles W. Heady, Perry, IA (US)

(73) Assignee: Power Brace, LLC, Des Moines, IA (US)

( * ) Notice: Subject to any disclaimer, the term of this patent is extended or adjusted under 35 U.S.C. 154(b) by 0 days.

(21) Appl. No.: 14/932,225

(22) Filed: Nov. 4, 2015

(51) Int. Cl.

| | |
|---|---|
| ***E04G 23/02*** | (2006.01) |
| ***E02D 35/00*** | (2006.01) |
| ***E02D 37/00*** | (2006.01) |
| ***E04G 23/04*** | (2006.01) |

(52) U.S. Cl.
CPC ..... *E04G 23/0218* (2013.01); *E02D 35/00* (2013.01); *E02D 37/00* (2013.01); *E04G 23/0229* (2013.01); *E04G 23/04* (2013.01)

(58) Field of Classification Search
CPC ..... E02D 37/00; E02D 35/00; E04G 23/0218; E04G 23/0229; E04G 23/04
See application file for complete search history.

(56) References Cited

U.S. PATENT DOCUMENTS

| | | | |
|---|---|---|---|
| 587,274 | A | 7/1897 | Rue |
| 1,031,049 | A | 7/1912 | Conzelman |
| 2,684,824 | A | 7/1954 | Hillberg |
| 2,914,147 | A | 11/1959 | Mallard |
| 3,030,061 | A | 4/1962 | Jennings |
| 3,095,666 | A | 7/1963 | Killen |
| 3,537,220 | A | 11/1970 | Ellis |
| 3,817,006 | A | 6/1974 | Williams |
| 3,874,625 | A | 4/1975 | Hansen et al. |
| 4,021,905 | A | 5/1977 | Benton et al. |
| 4,068,427 | A | 1/1978 | Camardo |
| 4,083,156 | A | 4/1978 | Tye |
| 4,189,891 | A | 2/1980 | Johnson et al. |
| 4,268,066 | A | 5/1981 | Davis |
| 4,288,899 | A | 9/1981 | McKee |
| 4,304,078 | A | 12/1981 | Meriwether, Jr. |
| 4,353,194 | A | 10/1982 | Norton |
| 4,365,451 | A | 12/1982 | Nelson |
| 4,452,019 | A | 6/1984 | Ikuo et al. |
| 4,465,648 | A | 8/1984 | Kiriyama et al. |
| 4,669,704 | A | 6/1987 | Abraham et al. |
| 4,752,214 | A | 6/1988 | Justus |
| 4,763,878 | A | 8/1988 | Abraham et al. |
| 4,872,634 | A | 10/1989 | Gillaspy et al. |

(Continued)

*Primary Examiner* — Andrew J Triggs
(74) *Attorney, Agent, or Firm* — McKee, Voorhees & Sease, PLC

(57) ABSTRACT

An improved a system for straightening and/or supporting a wall is provided. The system includes an elongated vertical member and an elongated horizontal member positioned to abut the wall. The elongated horizontal member has a first end and a second end, the former being positioned adjacent to the elongated vertical member. A cinch plate having at least two plates is provided. One of the plates is connected to the elongated vertical member. A driving member can be movably coupled to the other plates of the cinch plate and configured to force the elongated horizontal member to move relative to the elongated vertical member. Movement of the elongated horizontal member applies a corresponding force to the wall. The elongated horizontal member may not be connected to the elongated vertical member, but rather a compressive force applied between the driving member and the wall can vertically support the elongated horizontal member.

20 Claims, 10 Drawing Sheets

(56) References Cited

U.S. PATENT DOCUMENTS

| | | | | |
|---|---|---|---|---|
| 4,893,784 | A * | 1/1990 | Abraham | E02D 37/00 254/100 |
| 4,895,335 | A | 1/1990 | Oliver | |
| 4,930,285 | A | 6/1990 | Ward | |
| 4,937,989 | A | 7/1990 | Miyares et al. | |
| 4,970,835 | A | 11/1990 | Harmon | |
| 5,048,796 | A | 9/1991 | Maldonado | |
| 5,401,120 | A | 3/1995 | Hussey et al. | |
| 5,496,081 | A | 3/1996 | Rice | |
| 5,620,038 | A | 4/1997 | DeCola et al. | |
| 5,845,450 | A | 12/1998 | Larsen | |
| 5,857,300 | A | 1/1999 | Gates | |
| 5,875,606 | A | 3/1999 | Jensen | |
| 5,913,787 | A | 6/1999 | Edwards | |
| 5,943,830 | A | 8/1999 | Truitt | |
| 5,956,906 | A | 9/1999 | Berich et al. | |
| 5,983,587 | A | 11/1999 | Limonad | |
| 6,023,901 | A | 2/2000 | Jensen | |
| 6,073,405 | A | 6/2000 | Kasai et al. | |
| 6,112,475 | A | 9/2000 | Truitt | |
| 6,141,932 | A | 11/2000 | Tarrant | |
| 6,145,260 | A | 11/2000 | Morton | |
| 6,354,050 | B1 | 3/2002 | Pankoski | |
| 6,357,190 | B1 | 3/2002 | Florentine | |
| 6,450,480 | B2 | 9/2002 | Massile | |
| 6,539,677 | B1 | 4/2003 | Lanka | |
| 6,662,505 | B2 * | 12/2003 | Heady | E04G 23/0218 248/201 |
| 6,769,222 | B2 | 8/2004 | Billante | |
| 7,380,372 | B2 * | 6/2008 | Resch | E04G 23/0218 248/201 |
| 7,861,469 | B2 * | 1/2011 | Heady | E02D 37/00 248/201 |
| 8,209,935 | B2 * | 7/2012 | Heady | E02D 37/00 52/126.3 |
| 9,091,090 | B1 * | 7/2015 | Kirby | E04G 23/0218 |
| 2002/0062612 | A1 * | 5/2002 | Heady | E04G 23/0218 52/514 |
| 2003/0131555 | A1 * | 7/2003 | Heady | E04G 23/0218 52/741.15 |
| 2003/0192280 | A1 | 10/2003 | Billante | |
| 2005/0086889 | A1 | 4/2005 | Shock | |
| 2005/0204673 | A1 * | 9/2005 | Reed | E02D 37/00 52/514 |

* cited by examiner

SYSTEM AND METHOD FOR STRAIGHTENING AND/OR SUPPORTING A WALL

FIELD OF THE DISCLOSURE

The present disclosure relates generally to reinforcing and/or bracing a foundation. More particularly, but not exclusively, the present disclosure relates to a system and method for straightening and/or support a wall, particularly a wall that has been damaged due to expansive soils, hydrostatic pressure, freezing ground water, and/or other reasons.

BACKGROUND OF THE DISCLOSURE

In most homes having basements, the basements are at least partially subterranean. The basement foundation walls are design to support vertical loads more so than lateral loads from the surrounding earth. As a result, upon exposure to excessive lateral forces, foundation walls often crack, bow, push inward, or even collapse. The forces are associated with expansive soils, hydrostatic pressure, water pooling from downspouts, and/or freezing ground water, foundation settlement, and the like.

The foundation reinforcement systems commonly known in the art are deficient for a variety reasons. For example, wall anchoring systems counteract soil pressure by anchoring walls to stable, undisturbed soil outside the wall, which often requires significant excavation of surrounding earth. Further, given the varying types of soils outside of the wall, such systems are prone to failure. Therefore, a need exists in the art for a reinforcement system that does not require excavation of and/or rely on the use of soil exterior to the wall.

Many indoor foundation reinforcement systems occupy a large amount of interior space. For example, braces extending diagonally from the floor to the foundation wall significantly limit interior space of a room proximate to the foundation wall, often limiting overall function and enjoyment of the room. Therefore, a need exists in the art for a reinforcement system that minimizes the intrusive effect maximizes the interior space proximate to the wall and is aesthetically pleasing. For another example, braces spaced at a predetermined distance can result in localization of lateral loads at a midpoint between two adjacent vertical support members. Therefore, a further need exists in the art for a grid-like reinforcement system that adequately supports all areas of the foundation wall.

SUMMARY

It is therefore a primary object, feature, and/or advantage of the present disclosure to improve on or overcome the deficiencies in the art.

It is another object, feature, and/or advantage of the present disclosure to provide a system that not only stabilizes a wall, but also straightens the wall over time. Horizontal structural members can be supported by a compressive force between a driving member and the wall. The adjustment of the driving member forces the horizontal structural member to move relative to the vertical structural member, which forces the wall into a desired position.

It is yet another object, feature, and/or advantage of the present disclosure to install a wall reinforcement system without disruption to lawn, gardens, foliage, and/or other landscaping.

It is still yet another object, feature, and/or advantage of the present disclosure to provide a wall reinforcement system that maximizes the interior space proximate to the wall and is aesthetically pleasing.

It is another object, feature, and/or advantage of the present disclosure to straighten and/or support portions of the wall between vertical support members. The horizontal structural members extending between the vertical structural members can prevent any excessive localized stress at a midpoint between adjacent vertical support members.

It is yet another object, feature, and/or advantage of the present disclosure to provide a cinch plate that can be connected to the vertical structural members and/or the horizontal structural members without the use of welding or other permanent means.

It is still yet another object, feature, and/or advantage of the present disclosure to provide a system in which two cinch plates can be connected to opposite sides of the vertical support members with the same connection mechanism.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present disclosure, a system for straightening and/or supporting a wall is provided. The system includes an elongated vertical member and an elongated horizontal member positioned to abut the wall. The elongated horizontal member has a first end and a second end, the former being positioned adjacent to the elongated vertical member. A first cinch plate having a first plate and a second plate is provided. One of the plates is secured to the elongated vertical member. A driving member can be movably coupled to another one of the plates of the first cinch plate and configured to force the elongated horizontal member to move relative to the elongated vertical member. Movement of the elongated horizontal member applies a corresponding force to the wall. The elongated horizontal member may not be connected to the elongated vertical member. A compressive force applied between the driving member and the wall can vertically support the elongated horizontal member.

The system can include a second cinch plate having at least two plates. One of the plates can be rigidly connected to the elongated vertical member on a side opposite the first cinch plate. A bolting member can extend through the first cinch plate, the elongated vertical member, and the second cinch plate.

A second elongated horizontal member can be positioned to abut the wall and can have an end positioned adjacent to the elongated vertical member. A second driving member can movably connected to another one of the surfaces of the second cinch plate and configured to force the second elongated horizontal member to move relative to the elongated vertical member.

A second elongated vertical member can be positioned to abut the wall proximate to the second end of the elongated horizontal member. One of the plates of the second since plate can be removably connected to the second elongated vertical member. A second driving member can movably connected to another one of the plates of the second cinch plate and configured to force the elongated horizontal member to move relative to the elongated vertical member and the second elongated vertical member.

According to another aspect of the present disclosure, a method for straightening or supporting a wall includes the step of providing an elongated member, an elongated transverse member perpendicular to the elongated member, and a first cinch plate. The elongated member and the elongated transverse member are positioned to abut the wall. The elongated member is secured in a desired position to a floor. The first cinch plate is connected to the elongated member with a connector. A driving member associated with the cinch plate is adjusted to force a portion of the elongated transverse member to move relative to the elongated member.

The method can further include the step of providing a second elongated transverse member. The second elongated transverse member can be positioned to abut the wall. A second since plate can be attached to the elongated member with the same connector. A driving member associated with the second cinch plate can be adjusted to force the second elongated transverse member to move relative to the elongated member.

The method can further include the step of providing a second elongated member parallel to the elongated member. The second elongated member can be positioned adjacent to an end of the elongated transverse member opposite the first elongated member and secured to the floor. A second cinch plate can be connected to the second elongated member. A second driving member associated with the second cinch plate can be adjusted to force another portion of the elongated transverse member to move relative to the second elongated member.

According to yet another aspect of the present disclosure, a device for movably connecting a vertical structural member and a horizontal structural member is provided. The device includes a first plate having a hole and a second plate connected perpendicularly to the first plate. The second plate is configured to be removably connected to the vertical structural member. A driving member extends through the hole of the first plate and is configured to apply a horizontal force to the horizontal structural member.

The device can further include a threaded nut rigidly secured to a side of the first plate proximate to the vertical structural member. The driving member can be threadably engaged to the threaded nut. The horizontal force applied by a face of the driving member can vertically support the horizontal structural member. The first plate and the second plate can be integrally formed.

BRIEF DESCRIPTION OF THE DRAWINGS

Illustrated embodiments of the disclosure are described in detail below with reference to the attached drawing figures, which are incorporated by reference herein, and where.

DETAILED DESCRIPTION

Figure 1A:
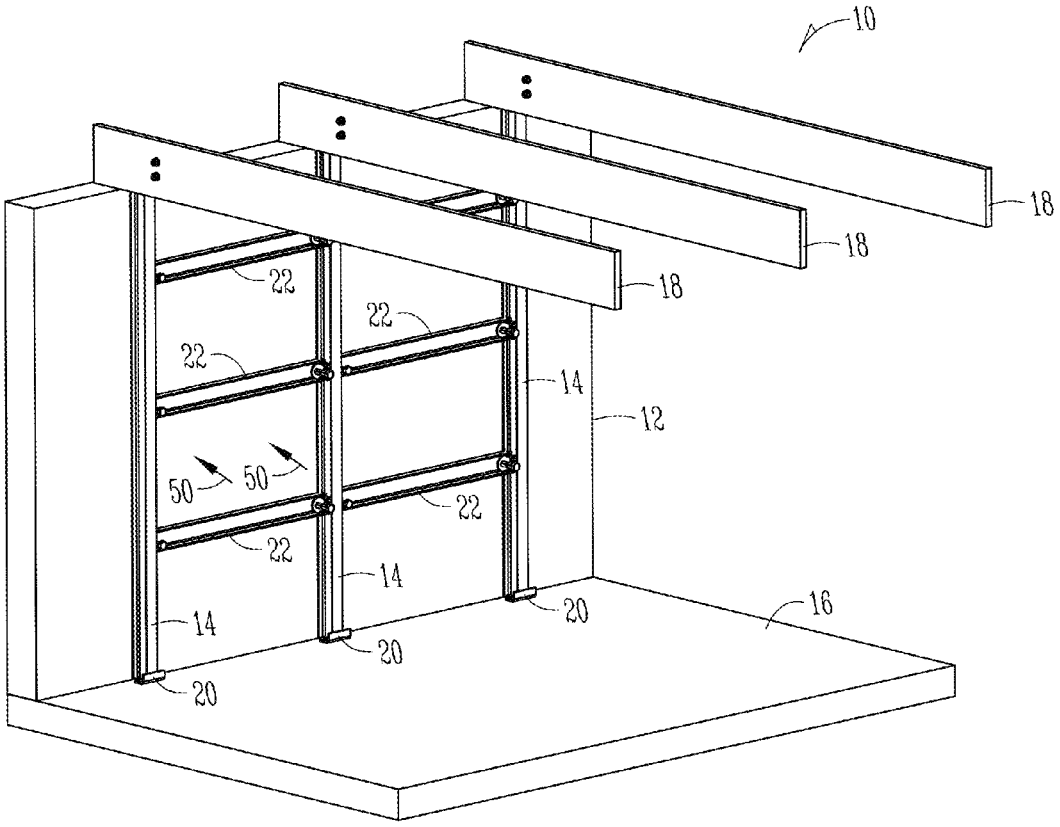
FIG. 1A is a front perspective view of a wall reinforcement system in accordance with an illustrative embodiment.
Figure 1B:
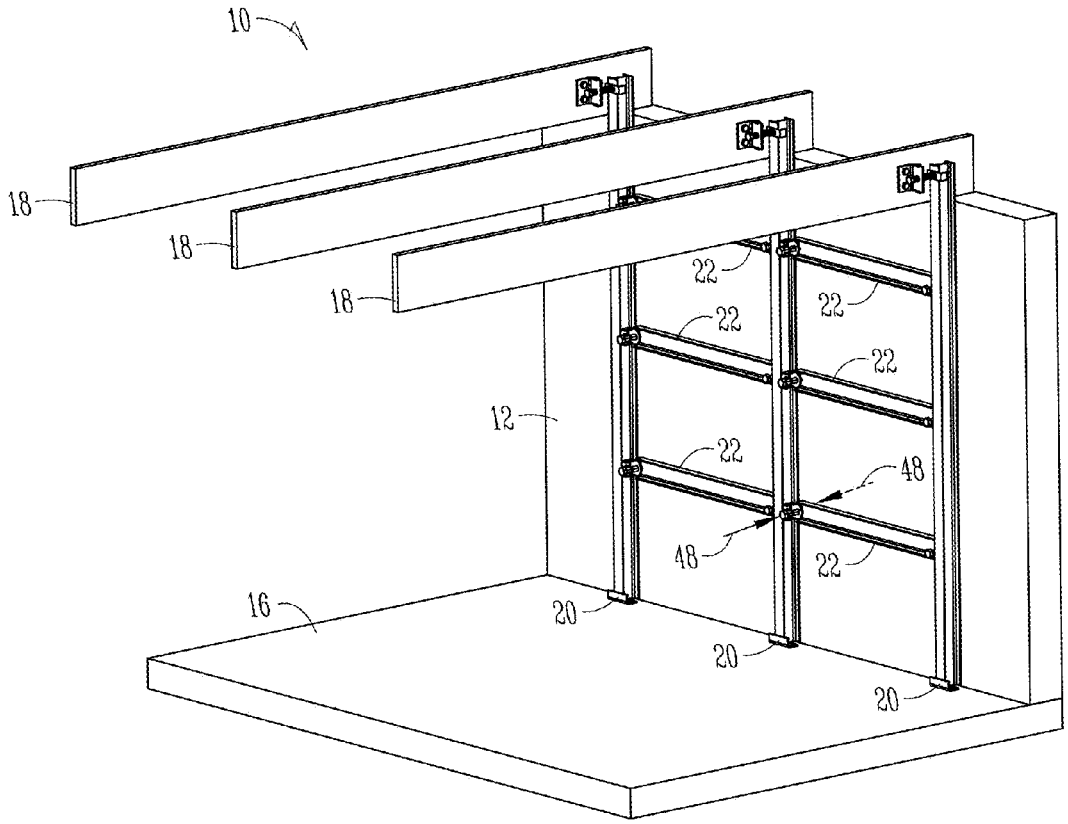
FIG. 1B is a front perspective view of a wall reinforcement system in accordance with an illustrative embodiment.
Figure 1C:
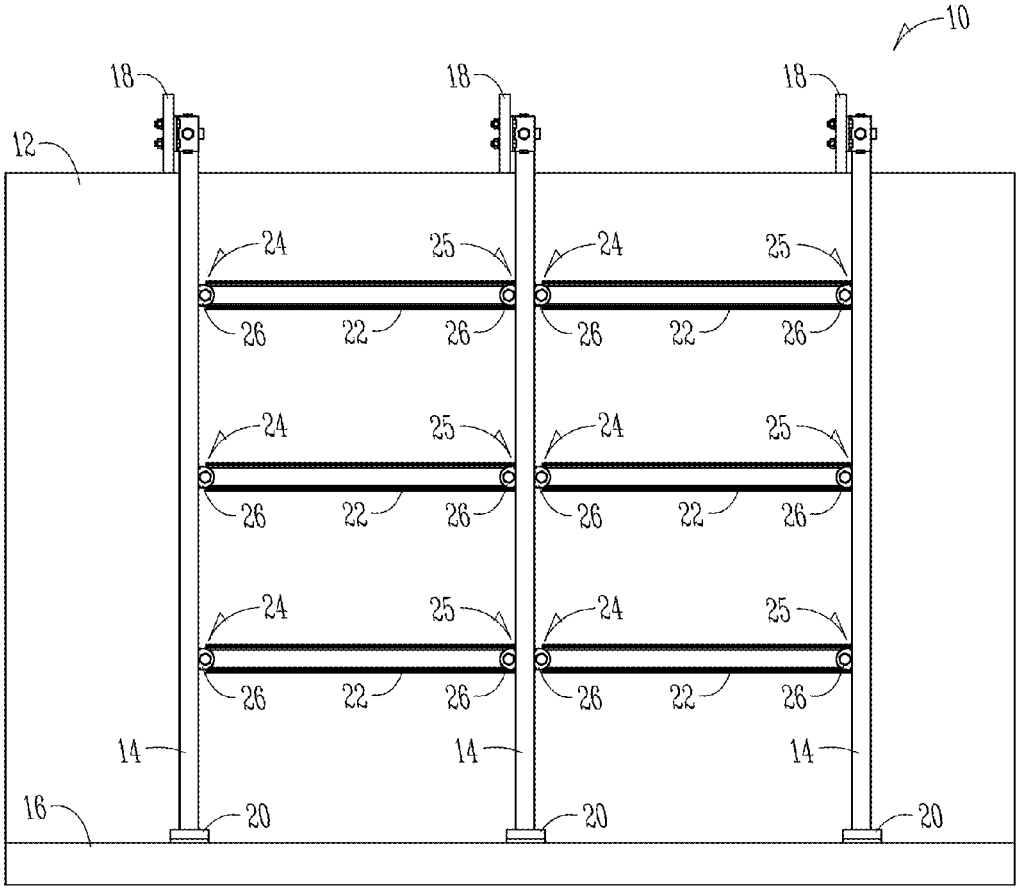
FIG. 1C is a front elevation view of a wall reinforcement system in accordance with an illustrative embodiment.

FIGS. 1A, 1B and 1C illustrate an exemplary wall reinforcement system 10. The system 10 is designed to support and/or straighten a wall 12. The system 10 is comprised of elongated vertical members 14 extending between a floor 16 and a ceiling structure 18. In an exemplary embodiment, the wall 12 and floor 15 comprise a basement foundation wall and floor, respectively. The ceiling structure 18 can comprise floor joists disposed below a main floor of a home. The present disclosure contemplates that the wall reinforcement system 10 can be installed with any type of interior or exterior walls of residential buildings, commercial building, and the like, as well as other types of planar surfaces having means to connect the elongated vertical members 14 at a top end and a bottom end.

The elongated vertical members 14, also referred to herein as vertical structural members, are secured to the floor 16 and adjustably connected to the ceiling structures 18, as disclosed in U.S. Pat. No. 6,662,505 to Heady et al., herein incorporated by reference in its entirety. FIGS. 1A, 1B and 1C illustrate support brackets 20 securing an end of the elongated vertical members 14 in a desired position proximate to the floor 16. The present disclosure envisions that the elongated vertical members 14 can be secured to the floor 16 and/or the base of the wall 12 through any means commonly known in the art, including adjustable brackets that loosely prevent movement of the elongated vertical members 14. Similarly, while FIGS. 1A, 1B and 1C illustrate an adjustable connection between the elongated vertical members 14 and the ceiling structures 18, the present disclosure contemplates the connection may be rigid through any connective means commonly known in the art. In an exemplary embodiment, the elongated vertical members 14 are I-beams having four-inch depth and weighing 7.7 pounds per foot. The elongated vertical member 14 can be comprised of ASTM A36 hot rolled steel or other suitable metal with the flexing properties needed of the application. In another exemplary embodiment, the elongated vertical members 14 can be T-beams, square bars, or rectangular plates. The elongated vertical members 14 are positioned to abut the wall.

Disposed between one or more of the elongated vertical members 14 can be one or more elongated horizontal members 22, also referred to herein as horizontal structural members. In an exemplary embodiment, the elongated horizontal members 22 are C-channel beams having four-inch depth and weighing 5.4 pounds per foot. The elongated horizontal member 22 can be comprised of ASTM A36 hot rolled steel or other suitable metal with the flexing properties needed of the application. The elongated horizontal members 22 are positioned to abut the wall. The elongated vertical members 14 and the elongated horizontal members 22 can collectively be arranged in a grid-like configuration, as shown illustratively in FIGS. 1A, 1B and 1C. The horizontal structural members advantageously prevent any excessive localized stress at a midpoint between adjacent vertical support members.

As illustrated in FIG. 1C, each of the elongated horizontal members 22 can have a first end 24 and a second end 25. The first end 24 can be positioned adjacent to an elongated vertical member 14 and the second end 25 can be positioned adjacent to a second elongated vertical member 14. Further, a second elongated horizontal member 22 can be positioned between a pair of elongated vertical members 14 above and/or below the elongated horizontal member 22. While the exemplary embodiment illustrated in FIG. 1C has three elongated horizontal members 22 disposed between a pair of elongated vertical members 14, any number of elongated horizontal members 22 can be installed between a pair of elongated vertical members 14 without deviating from the objects of the present disclosure. Similarly, any number of elongated vertical members 14 can be installed against the wall 12 without deviating from the objects of the present disclosure.

Figure 5:
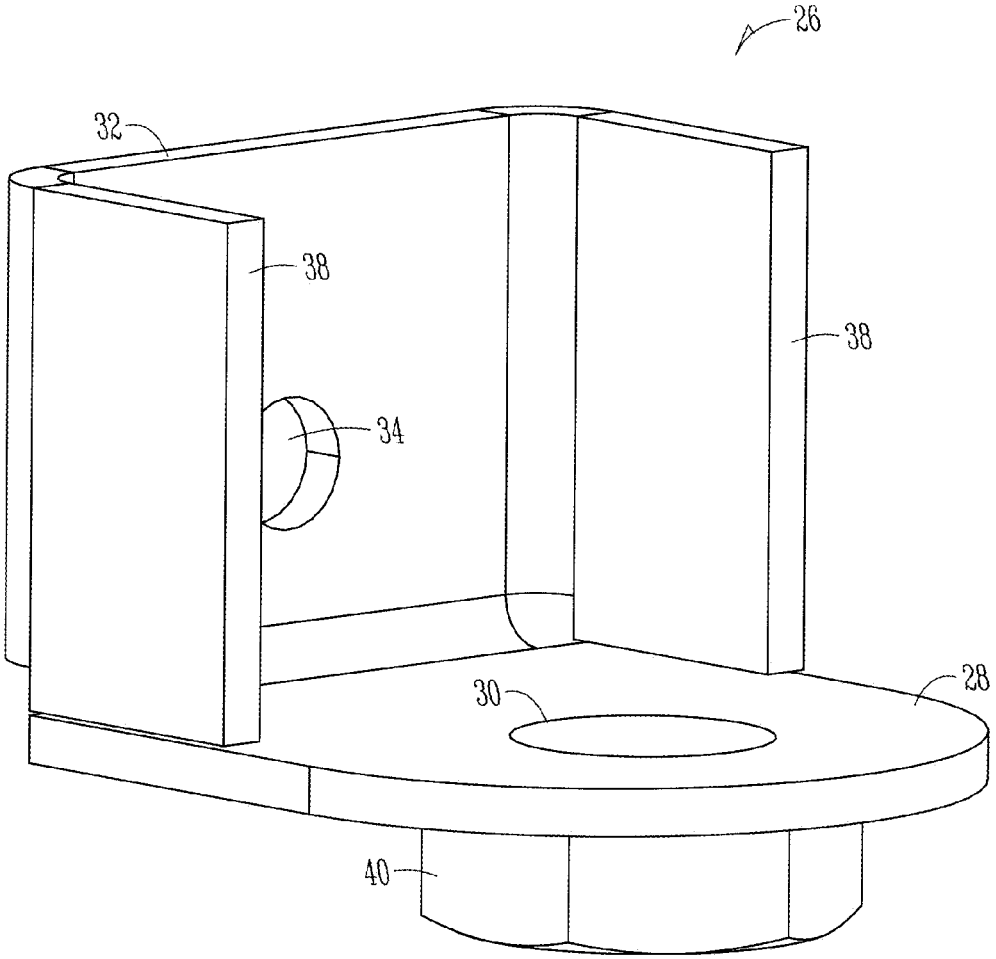
FIG. 5 is a front perspective view of a cinch plate in accordance with an illustrative embodiment.

Each of the elongated vertical members 14 and the elongated horizontal members 22 are coupled with a cinch plate 26. Referring to FIG. 5, the cinch plate 26 is comprised of a first plate 28 or surface having a hole 30, and a second plate 32 having a hole 34. In an exemplary embodiment, the first plate 28 and the second plate 32 are perpendicular. The first plate 28 and the second plate 32 can be integrally formed or otherwise rigidly connected. Further, in the illustrated exemplary embodiment of FIG. 5, the holes 30, 34 are centered along the width of the cinch plate 26. The hole 34 of the second plate 32 allows connection to an elongated vertical member 14, as shown illustratively in FIG. 2A. The cinch plate 26 can be removably connected to the elongated vertical member with a connector 36. In an exemplary embodiment, the connector 36 is a bolting member extending between the cinch plate 26 and the elongated vertical member 14. The bolting of the two components permits for ease of installation over methods commonly known in the art such as welding.

The cinch plate 26 can also comprise opposing flanges 38 extending perpendicular from opposite sides of the second plate 32, as shown illustratively in FIG. 5. The opposing flanges 38 can be oriented perpendicular to the second plate 32 and orthogonal to the first plate 28. The opposing flanges 38 can be integrally formed with the first plate 28 and/or the second plate 32, or otherwise rigidly connected to the same. The opposing flanges 38 can provide added strength to the cinch plate 26 during operation, which will be discussed in detail below.

Figure 6A:
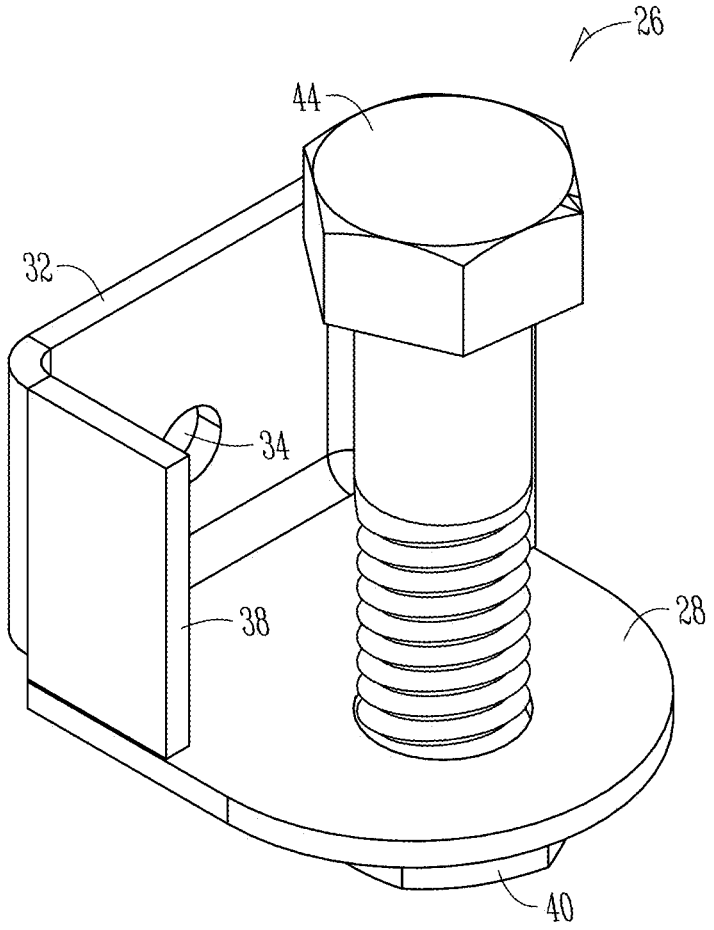
FIG. 6A is a side elevation view of a cinch plate and driving member in accordance with an illustrative embodiment.
Figure 6B:
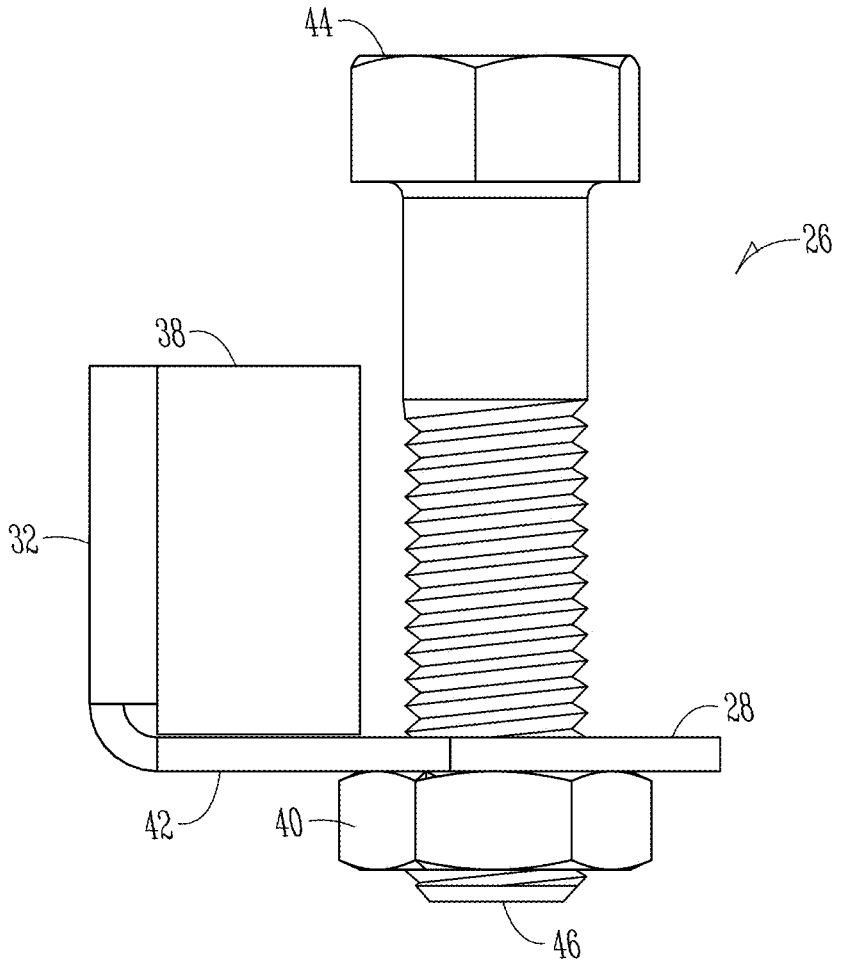
FIG. 6B is a front perspective view of a cinch plate and driving member in accordance with an illustrative embodiment.

Referring to FIGS. 6A and 6B, a threaded jam nut 40 can be rigidly secured to a face 42 of the first plate 28. The face 42 can be proximate to the elongated vertical member 14 to which the cinch plate is removably joined, as shown illustratively in FIG. 2B. In such a configuration, the threaded jam nut 40 is forced towards the first plate 28 in operation, minimizing the stress on (and possible failure of) the interface between the two. In an exemplary embodiment, the threaded jam nut 40 is welded to the face 24; however, the present disclosure contemplates any means for joining the threaded jam nut 40 commonly known in the art, including but not limited to clamping, pinning, adhesion, and brazing. In another exemplary embodiment, the jam nut 40 is a cylinder formed integrally during manufacturing of the cinch plate 26, after which the inner diameter is bored and threaded. A driving member 44 extends through the hole 30 of the first plate 28 and threadably engages the threaded jam nut 40. In an exemplary embodiment, the driving member 44 is a Hex bolt with a one-inch diameter. In another exemplary embodiment, the driving member 44 is a Hex bolt with a five-eighths-inch diameter.

Figure 2A:
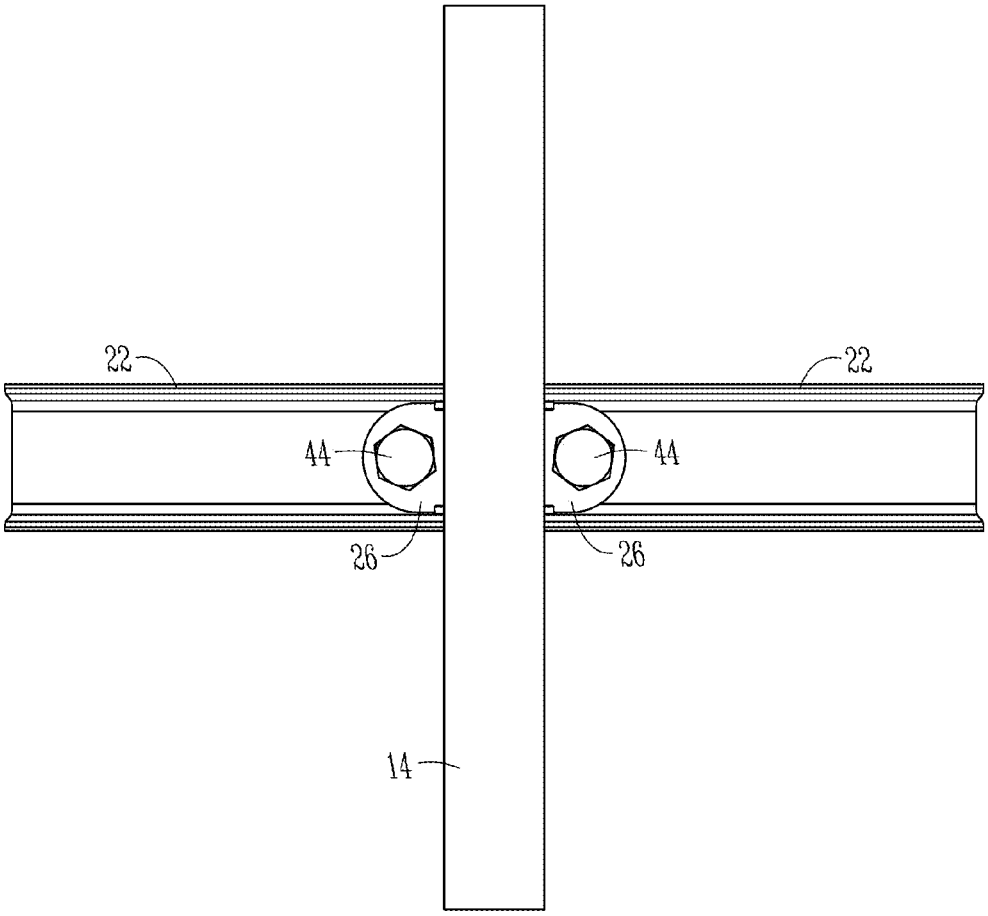
FIG. 2A is a front elevation view of a portion of a wall reinforcement system in accordance with an illustrative embodiment.
Figure 2B:
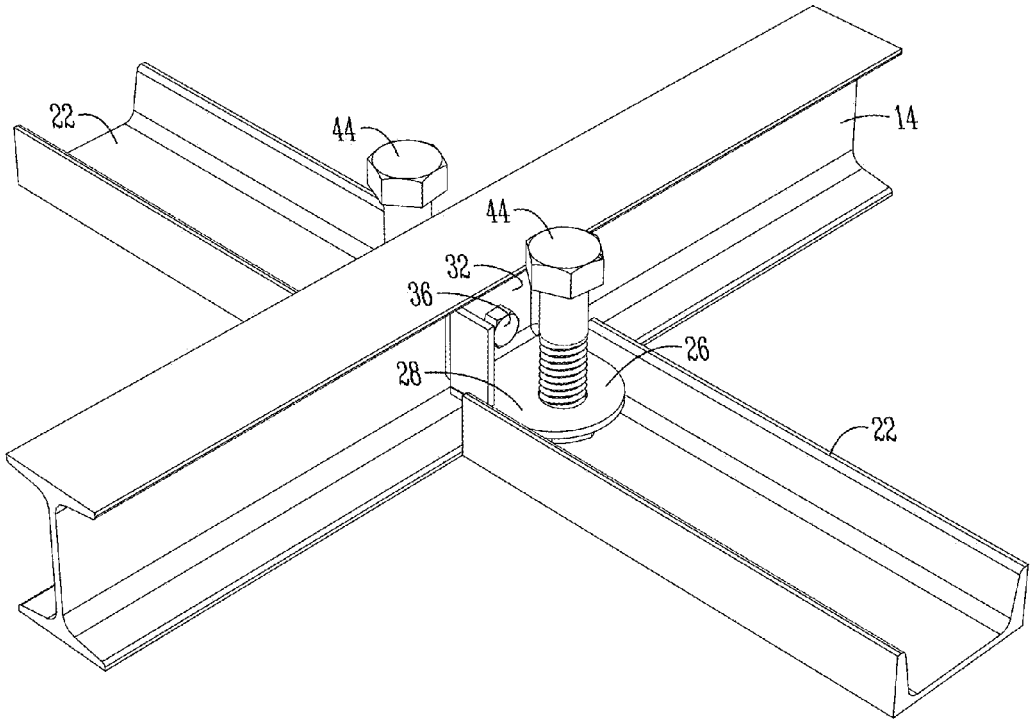
FIG. 2B is an isometric view of a portion of a wall reinforcement system in accordance with an illustrative embodiment.
Figure 4:
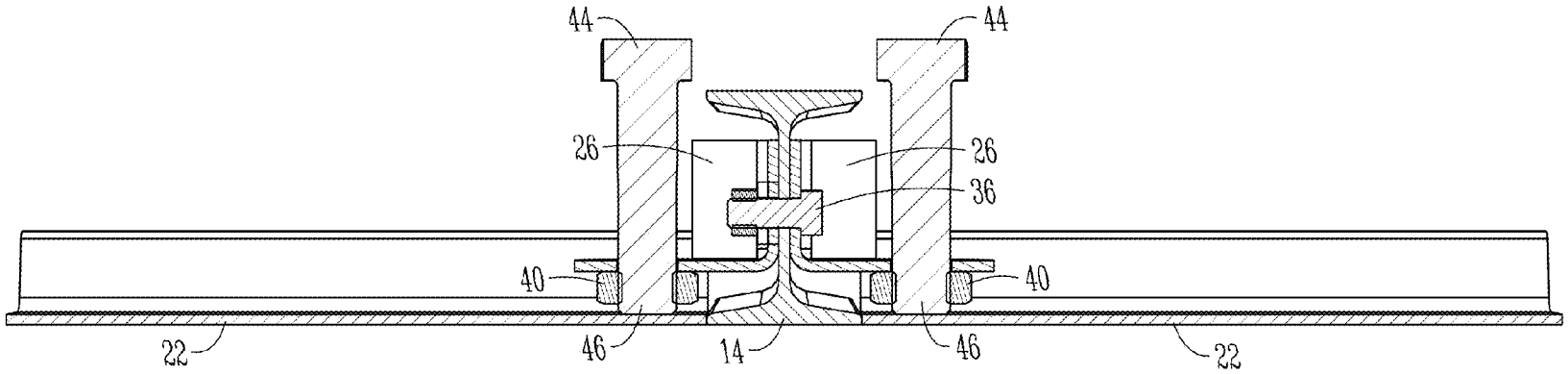
FIG. 4 is a cross-section view of the wall reinforcement system of FIG. 3 taken across section lines 4-4.

Referring to FIGS. 2A, 2B and 4, a cinch plate 26 is disposed on each side of an elongated vertical member 14. As shown illustratively in FIG. 4, a single connector 36, or bolting member, connects two cinch plates 26 to the elongated vertical member 14. In particular, the connector 36 extends through the second plate 32 of a first cinch plate 26, the elongated vertical member 14, and a second cinch plate 26 on a side of the vertical member 14 opposite the first cinch plate 26.

Figure 3:
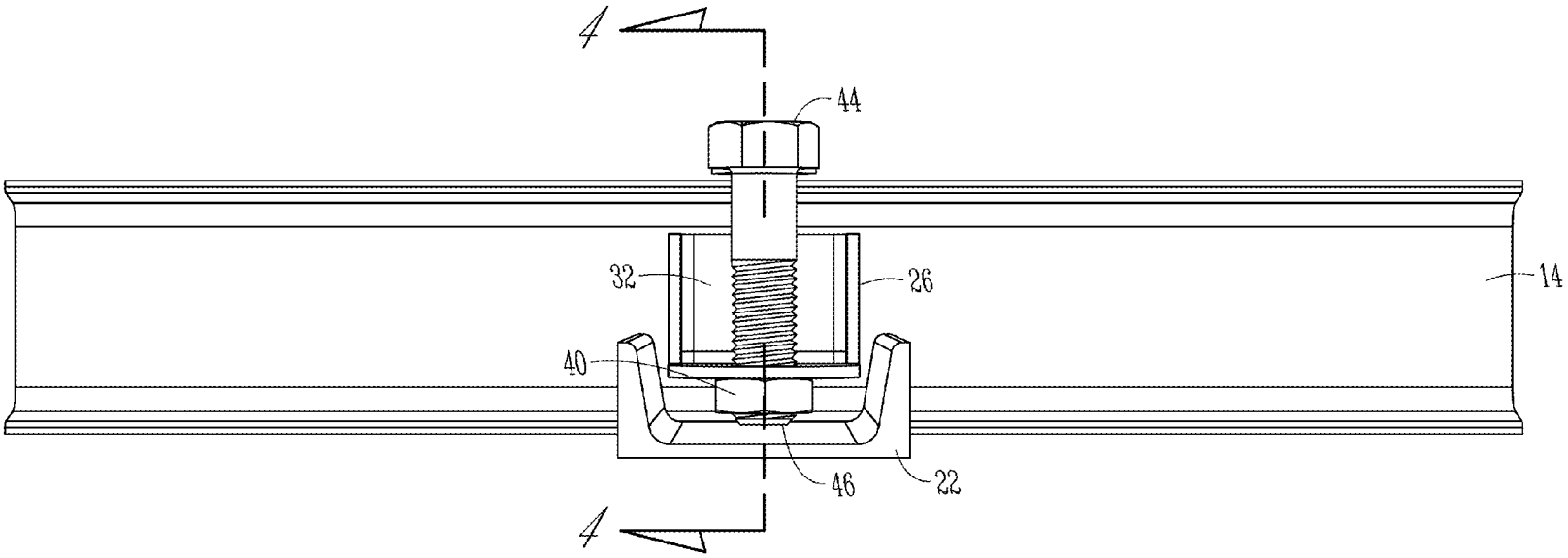
FIG. 3 is a side elevation view of a portion of a wall reinforcement system in accordance with an illustrative embodiment.

Each of the cinch plates 26 engages an elongated horizontal member 22. However, the cinch plates 26 may not be rigidly connected to the elongated horizontal member 22. Rather, the driving member 44 has a face 46 that extends past the base of the threaded jam nut 40 and contacts the elongated horizontal member, as shown illustratively in FIGS. 3 and 4. Furthermore, the elongated horizontal member 22 may not be rigidly connected to the elongated vertical member 14, as shown illustratively in FIGS. 2B and 4. Rather, the elongated horizontal members 22 are vertically supported by a compressive force 48 (FIG. 1B) between the driving member 44 and the wall 12. As the driving member 44 is rotated clockwise within the threaded jam nut 40 (i.e., tightened), a greater portion of the driving member 44 extends below the base of the threaded jam nut 40. As this occurs, the face 46 of the driving member 44 applies a horizontal force 50 to the elongated horizontal member 22, which applied a corresponding horizontal force to the wall 12. The horizontal force moves the wall 12 into a desired, most often straighter, position.

The driving member 44 associated with each cinch plate 26 can be independently adjusted, thereby advantageously providing precise reinforcement based on the needs of the application. For example, a driving member 44 may apply a horizontal force 50 to the first end 24 of one of the elongated horizontal members 22, thereby forcing a portion of the elongated horizontal member 22 to move relative to the elongated vertical member 14 Then, a second driving member 24 associated with a second cinch plate 26 may apply a horizontal force 50 to the second end 25 of the elongated horizontal members 22, thereby forcing another portion of the elongated horizontal member 22 to move relative to the elongated vertical member 14.

To install the system 10, at least two elongated vertical members 14 are secured to the floor 14 and ceiling structures 18. The elongated vertical members 14 can have holes corresponding to the attachment point of a cinch plate 26. An elongated horizontal member 22 is disposed between the two elongated vertical members 14 and temporarily held in place manually or through any means commonly known in the art. A cinch plate 26 is connected to each elongated vertical member 14 with a connector 36. Further, two cinch plates 26 can be connected to opposing sides of the elongated vertical member 14 with the same connector 36 as previously expressed herein. A driving member 44 is threaded through the threaded jam nut 40 such that the face 46 of the driving member 44 is in contact with the elongated horizontal member. The same process is performed with a driving member 44 and the cinch plate 26 associated with the other elongated vertical member. The driving members 44 are torqued to the extent that the compressive force 48 between the wall 12 and the driving members 44 vertically secures the elongated horizontal member 22. Each of the driving members 44 can be further torqued to place a desired horizontal force 50 on respective portions the elongated horizontal member 22 to force the elongated horizontal member to move the wall 12. A third elongated vertical member 14 can be installed, after which the process of installing one or more horizontal members 22 is repeated. The overall process can be repeated as many times as required to appropriately reinforce a portion of a wall 12 or the entire wall 12.

The disclosure is not to be limited to the particular embodiments described herein. In particular, the disclosure contemplates numerous variations in the type of ways in which embodiments of the disclosure can be applied to straightening and/or supporting a wall. The foregoing description has been presented for purposes of illustration and description. It is not intended to be an exhaustive list or limit any of the disclosure to the precise forms disclosed. It is contemplated that other alternatives or exemplary aspects that are considered included in the disclosure. For example, the structure and function of the elongated vertical members 14 and the elongated horizontal members 22 can be switched. In such an exemplary embodiment, the elongated horizontal members 22 extend between, for example, two opposing sidewalls of a room. The elongated vertical members 14 would then extend between a pair of elongated horizontal members 22 and perform the functions of the same previously expressed herein. The description is merely examples of embodiments, processes or methods of the disclosure. It is understood that any other modifications, substitutions, and/or additions can be made, which are within the intended spirit and scope of the disclosure. For the foregoing, it can be seen that the disclosure accomplishes at least all that is intended.

The previous detailed description is of a small number of embodiments for implementing the disclosure and is not intended to be limiting in scope. The following claims set forth a number of the embodiments of the disclosure with greater particularity.

What is claimed is:

1. A system for straightening or supporting a wall, the system comprising:

an elongated vertical member having a flange portion positioned to abut the wall and a web portion substantially perpendicular to the flange portion;

an elongated horizontal member positioned to abut the wall and having a first end and a second end, wherein the first end is positioned adjacent to the elongated vertical member;

a first cinch plate having a first plate, and a second plate substantially perpendicular to the first plate and removably secured to the web portion of the elongated vertical member;

a driving member movably coupled to the first plate of the first cinch plate and configured to force the elongated horizontal member to move relative to the elongated vertical member; and wherein movement of the elongated horizontal member applies a horizontal force to the wall.

2. The system of claim 1, further comprising a second cinch plate having a first plate and a second plate substantially perpendicular to the first plate and removably secured to the web portion of the elongated vertical member on a side opposite the first cinch plate.

3. The system of claim 2, further comprising:

a second elongated horizontal member positioned to abut the wall and having an end positioned adjacent to the elongated vertical member; and a second driving member movably connected to the first plate of the second cinch plate and configured to force the second elongated horizontal member to move relative to the elongated vertical member.

4. The system of claim 3 wherein the elongated horizontal member and the second elongated horizontal member are independently moveable relative to the elongated vertical member.

5. The system of claim 2 further comprising a bolting member extending through the first cinch plate, the web portion of the elongated vertical member, and the second cinch plate.

6. The system of claim 1, further comprising:

a flange portion of the second elongated vertical member positioned to abut the wall proximate to the second end of the elongated horizontal member;

a second cinch plate having a first plate and a second plate, wherein the second plate is secured to the second elongated vertical member; and a second driving member movably connected to the first plate of the second cinch plate and configured to force the elongated horizontal member to move relative to the elongated vertical member and the second elongated vertical member.

7. The system of claim 1 wherein the elongated horizontal member is not directly connected to the elongated vertical member; and wherein a compressive force applied between the driving member and the wall vertically supports the elongated horizontal member.

8. The system of claim 1 wherein the elongated vertical member is an I-beam.

9. A method for straightening or supporting a wall, the method comprising the steps of:

providing an elongated member having a flange portion and a web portion substantially perpendicular to the flange portion, an elongated transverse member perpendicular to the elongated member, and a first cinch plate comprised of a plurality of plates;

positioning the flange portion of the elongated member and the elongated transverse member to abut the wall;

securing the elongated member in a desired position on a floor;

securing one of the plurality of plates of the first cinch plate to the web portion of the elongated member with a connector; and adjusting a driving member associated with first cinch plate and substantially parallel to the one plate of the first cinch plate, wherein the driving member forces the elongated transverse member proximate to the elongated member to move relative to the elongated member.

10. The method of claim 9, further comprising the steps of:

providing a second elongated transverse member;

positioning the second elongated transverse member to abut the wall; and attaching a second cinch plate to the elongated member with the same connector.

11. The method of claim 10, further comprising the step of adjusting a driving member associated with the second cinch plate to force the second elongated transverse member to move relative to the elongated member.

12. The method of claim 9, further comprising the steps of:

providing a second elongated member parallel to the first elongated member and having a flange portion and a web portion substantially perpendicular to the flange portion;

positioning the flange portion of the second elongated member adjacent to an end of the elongated transverse member opposite the elongated member;

securing the second elongated member in a desired position on the floor;

securing a second cinch plate to the web portion of the second elongated member;

adjusting a second driving member associated with the second cinch plate to force another portion of the elongated transverse member to move relative to the second elongated member.

13. The method of claim 9 further comprising the step of removing the first cinch plate from the elongated member.

14. A device for movably connecting a vertical structural member having a flange portion and a web portion substantially perpendicular to the flange portion, and a horizontal structural member, the device comprising:

a first plate having opposing faces and a hole extending through the opposing faces;

a second plate perpendicular to the first plate and having opposing faces and a hole extending through the opposing faces, wherein one of the opposing faces of the second plate is configured to be removably secured to the web portion of the vertical structural member; and a driving member extending through the hole of the first plate and configured to apply a horizontal force to the horizontal structural member.

15. The device of claim 14, further comprising:

a threaded nut rigidly secured to one of the opposing faces of the first plate proximate to the flange portion of the vertical structural member.

16. The device of claim 15 wherein the driving member is threadably engaged to the threaded nut.

17. The device of claim 14 wherein the horizontal force applied by the driving member vertically supports the horizontal structural member.

18. The device of claim 14 wherein the first plate and the second plate are integrally formed.

19. The device of claim 14 further comprising:

opposing flanges extending perpendicularly from opposite sides of the second plate in a direction orthogonal to the first plate.

20. The device of claim 19 wherein the first plate, the second plate and the opposing flanges are integrally formed.

* * * * *